US011235223B1

(12) United States Patent
Fernandez

(10) Patent No.: US 11,235,223 B1
(45) Date of Patent: Feb. 1, 2022

(54) AUTOMATED PROJECTILE LAUNCHER DEVICE FOR LAUNCHING BIODEGRADABLE PROJECTILES

(71) Applicant: FLE-INNOVATIONS LLC, Peekskill, NY (US)

(72) Inventor: Felix Fernandez, Peekskill, NY (US)

(73) Assignee: FLE-INNOVATIONS LLC, Peekskill, NY (US)

( * ) Notice: Subject to any disclaimer, the term of this patent is extended or adjusted under 35 U.S.C. 154(b) by 0 days.

(21) Appl. No.: 17/242,118

(22) Filed: Apr. 27, 2021

Related U.S. Application Data

(60) Provisional application No. 63/077,877, filed on Sep. 14, 2020.

(51) Int. Cl.

| | |
|---|---|
| ***A63B 69/00*** | (2006.01) |
| ***A63B 69/40*** | (2006.01) |
| ***A63B 43/00*** | (2006.01) |
| *A63B 102/18* | (2015.01) |

(52) U.S. Cl.
CPC ..... *A63B 69/406* (2013.01); *A63B 43/00* (2013.01); *A63B 69/0002* (2013.01); *A63B 69/40* (2013.01); *A63B 2069/0008* (2013.01); *A63B 2102/18* (2015.10); *A63B 2102/182* (2015.10); *A63B 2209/18* (2020.08)

(58) Field of Classification Search
CPC ..... A63B 69/406; A63B 69/40; A63B 2069/0008; A63B 43/00; A01K 15/026
See application file for complete search history.

(56) References Cited

U.S. PATENT DOCUMENTS

| | | | | | |
|---|---|---|---|---|---|
| 4,834,060 | A * | 5/1989 | Greene | A63B 69/406 | 124/78 |
| 4,995,374 | A * | 2/1991 | Black | A01K 15/025 | 124/32 |
| 5,107,820 | A * | 4/1992 | Salansky | A63B 69/40 | 124/48 |
| 5,265,583 | A * | 11/1993 | Otto | A63B 69/40 | 124/26 |
| 5,619,977 | A * | 4/1997 | Gatin | A63B 69/408 | 124/16 |
| 5,649,523 | A * | 7/1997 | Scott | A63B 69/406 | 124/78 |

(Continued)

*Primary Examiner* — John E Simms, Jr.

(57) ABSTRACT

The automated projectile launching device is a pitching machine that can launch biodegradable balls. The device is intended to provide a portable batter-training implement, that is capable of giving the user the change in velocity, angle of pitch and change in range, that comes naturally because of the variations in dimensions of bio-degradable balls. The use of bio-degradable balls further prevents the need to collect the balls after practice as they break on forced contact into smaller pieces and dissolve when wet with water, making it environment friendly. Furthermore, the compact, lightweight, and portable pitching machine includes multiple placement and incline options. Additionally, the device includes multiple components that are flexible, for the smooth handling of the bio-degradable balls. Thus, the automated projectile launching device is a unique training aid for all hitters, that can provide various pitch locations and angle variations effortlessly, and thus effective training.

12 Claims, 12 Drawing Sheets

(56) References Cited

U.S. PATENT DOCUMENTS

| | | | | |
|---|---|---|---|---|
| 2003/0125139 | A1* | 7/2003 | Gottlieb-Myers | A63B 69/406<br>473/451 |
| 2009/0095273 | A1* | 4/2009 | Paulson | A63B 69/406<br>124/78 |
| 2013/0104870 | A1* | 5/2013 | Rizzo | A63B 69/40<br>124/78 |
| 2014/0109887 | A1* | 4/2014 | Edson | A63B 47/04<br>124/78 |
| 2016/0262351 | A1* | 9/2016 | Hamill | A01K 15/027 |
| 2016/0296814 | A1* | 10/2016 | Hsu | A63B 65/12 |
| 2017/0252630 | A1* | 9/2017 | Tomlinson | A63B 69/002 |
| 2017/0326414 | A1* | 11/2017 | York | A63B 63/08 |
| 2017/0326428 | A1* | 11/2017 | Qian | A63B 69/406 |
| 2018/0056155 | A1* | 3/2018 | McAuley | A63B 69/3623 |
| 2018/0193711 | A1* | 7/2018 | Kim | A63B 69/0075 |
| 2019/0008120 | A1* | 1/2019 | Hamill | A63B 47/00 |

* cited by examiner

AUTOMATED PROJECTILE LAUNCHER DEVICE FOR LAUNCHING BIODEGRADABLE PROJECTILES

The current application claims a priority to the U.S. Provisional Patent application Ser. No. 63/077,877 filed on Sep. 14, 2020.

FIELD OF THE INVENTION

The present invention generally relates to the field of mechanized training aids for baseball and softball. This apparatus is specifically directed towards launching a bio-degradable projectile towards a batter and giving the user variations in velocity, angle of pitch and change in range.

BACKGROUND OF THE INVENTION

Utilizing conventional pitching machines, a trainee can expect consistent tosses across a predictable arc from a simulated pitcher's mound across home plate. This arrangement may be suitable for most users, but it is understood that in practice (i.e. during a real game) pitchers are likely to avoid being overly predictable to reduce the odds of a batter forecasting a pitch. This flexibility cannot be effectively simulated using a fixed-power pitching machine, nor can a batter-in-training be expected to fully prepare for real games without experiencing some variation in the power, speed, and incidence angle of a pitch. Further, it is proposed that common pitching machines may be too large or power-intensive to allow for rapid deployment outside of dedicated training facilities. A smaller, more portable implement may enable a user to engage in batting practice anywhere, including in enclosed areas with a suitably down-scaled iteration of the present invention. Furthermore, a training aid that would allow the user to focus on improving their hitting mechanism and their approach without needed the time to go and pick up the synthetic balls from the ground is also a rare find in the current market.

An objective of the present invention is to provide users with an automated projectile launching device that can launch biodegradable balls. It is an aim of the present invention to provide a portable batter-training implement, that is capable of giving the user the change in velocity, angle of pitch and change in range, that comes naturally because of the variations in the size and weight of biodegradable balls. The use of biodegradable balls further prevents the need to collect the balls after practice as they break on forced contact into smaller pieces and dissolve when wet with water, making it environment friendly. Furthermore, the compact, lightweight, and portable pitching machine comprises multiple options for hanging and orienting the device, according to the users' preference and practice location. Additionally, the present invention comprises multiple components such as a ball shaker, a rotating arm, spinning wheels etc., that comprises flexible and soft materials that cater to the smooth handling of the biodegradable projectiles. Thus, the present invention is a unique training aid for all hitters, that can provide various pitch location due to the variation in the projectile dimensions as well as the component assembly of the present invention.

DETAIL DESCRIPTIONS OF THE INVENTION

Figure 1:
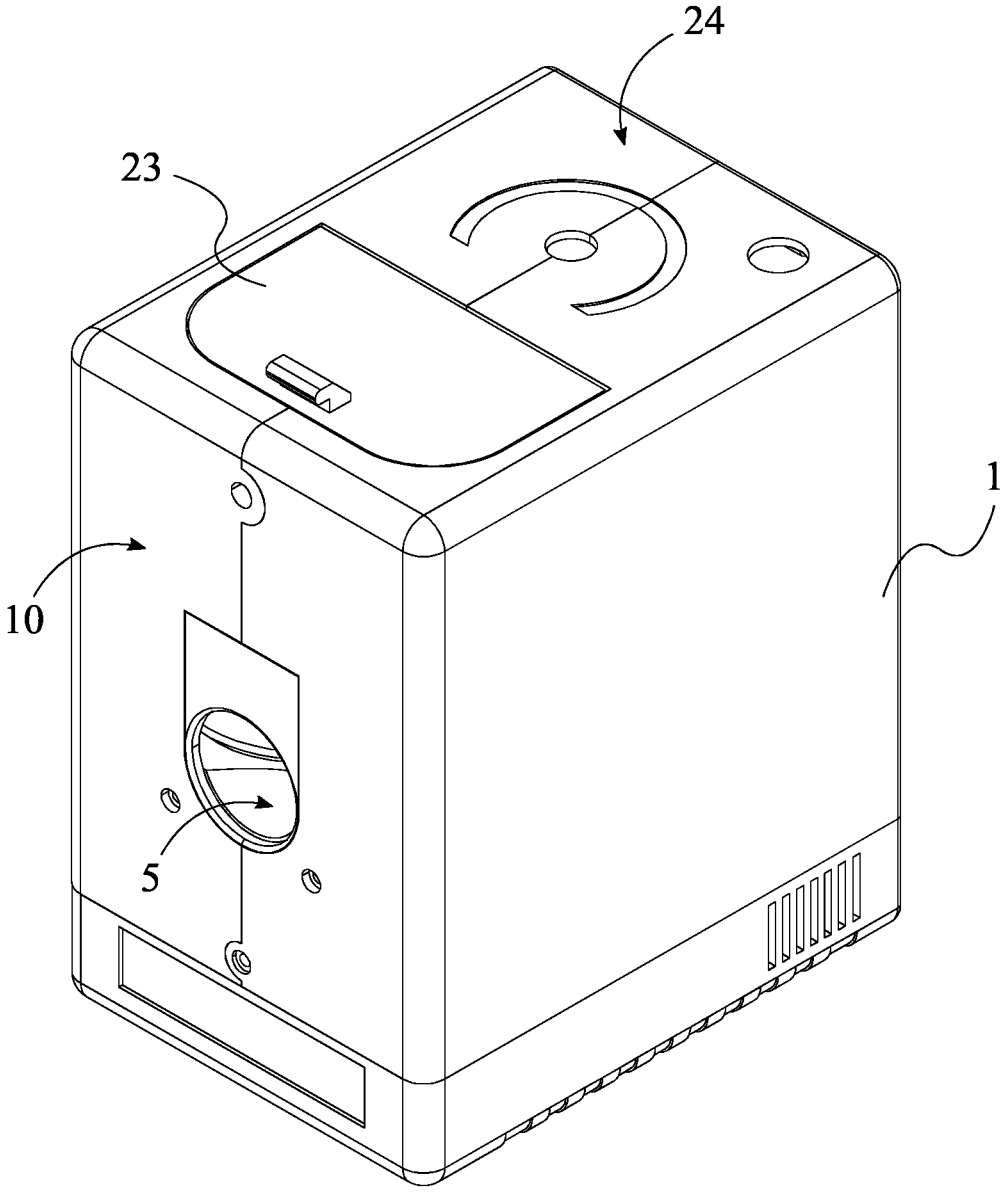
FIG. 1 is a top-front-left perspective view of the present invention.

All illustrations of the drawings are for the purpose of describing selected versions of the present invention and are not intended to limit the scope of the present invention.

In reference to FIG. 1 through FIG. 12, the present invention is an automated bio-degradable projectile launcher. An objective of the present invention is to provide users with an automated projectile launching device that can launch bio-degradable balls. It is an aim of the present invention to provide a portable batter-training implement, that is capable of giving the user the change in velocity, angle of pitch and change in range, that comes naturally because of the variations in the size and weight of bio-degradable balls. The use of bio-degradable balls further prevents the need to collect the balls after practice as they break on forced contact into smaller pieces and dissolve when wet with water, making it environment friendly. Furthermore, the compact, lightweight, and portable pitching machine comprises multiple options for hanging and orienting the device, according to the users' preference and practice location. Additionally, the present invention comprises multiple components such as a ball shaker, a rotating arm, spinning wheels etc., that comprises flexible and soft materials that cater to the smooth handling of the bio-degradable balls. Thus, the present invention is a unique training aid for all hitters, that can provide various pitch location due to the variation in the projectile dimensions as well as the component assembly of the present invention.

The following description is in reference to FIG. 1 through FIG. 12. According to a preferred embodiment, the present invention comprises a main housing 1, a ball carrier 2, a launcher 3, a powering unit 4, and a launching port 5. Preferably, the main housing 1 provides a protective covering or casing for all the main components of the present invention, and the main housing 1 is designed around the capability of the launcher 3 and the volume of projectiles used. To that end, the ball carrier 2, the launcher 3, and the powering unit 4 are mounted within the main housing 1. As seen in FIG. 1 through FIG. 8, the main housing's design is meant for a compact, very efficient, light weight, durable, portable and easy to use functionality. Further, the main housing 1 has a variation of cut outs, ports and apertures that will give accessibility to various internal components and thus a user-friendly experience for the user. Furthermore, in the preferred embodiment, the main housing 1 comprises a cubical structure. However, the main housing 1 may comprise any other shape, size, components and arrangement of components that are known to one of ordinary skill in the art, as long as the intents of the present invention are not altered.

Figure 6:
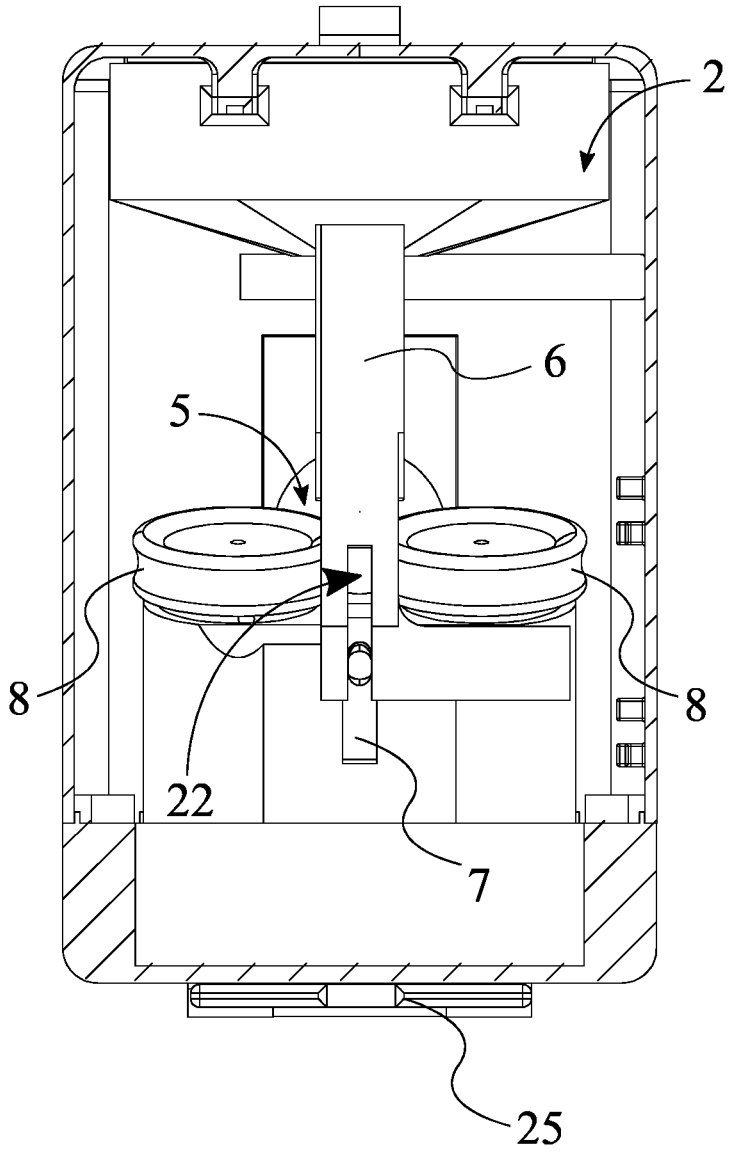
FIG. 6 is a sectional view of the present invention, taken along A-A' of FIG. 5.
Figure 7:
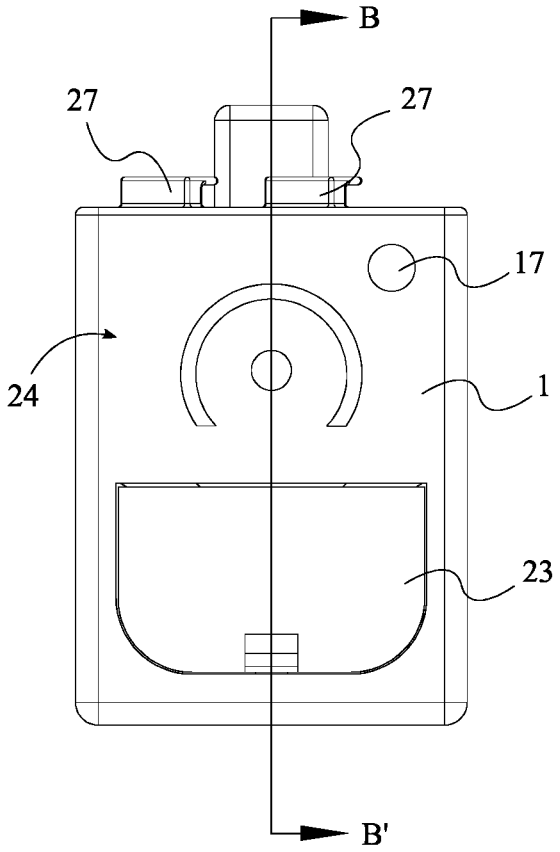
FIG. 7 is a top plan view of the present invention.
Figure 8:
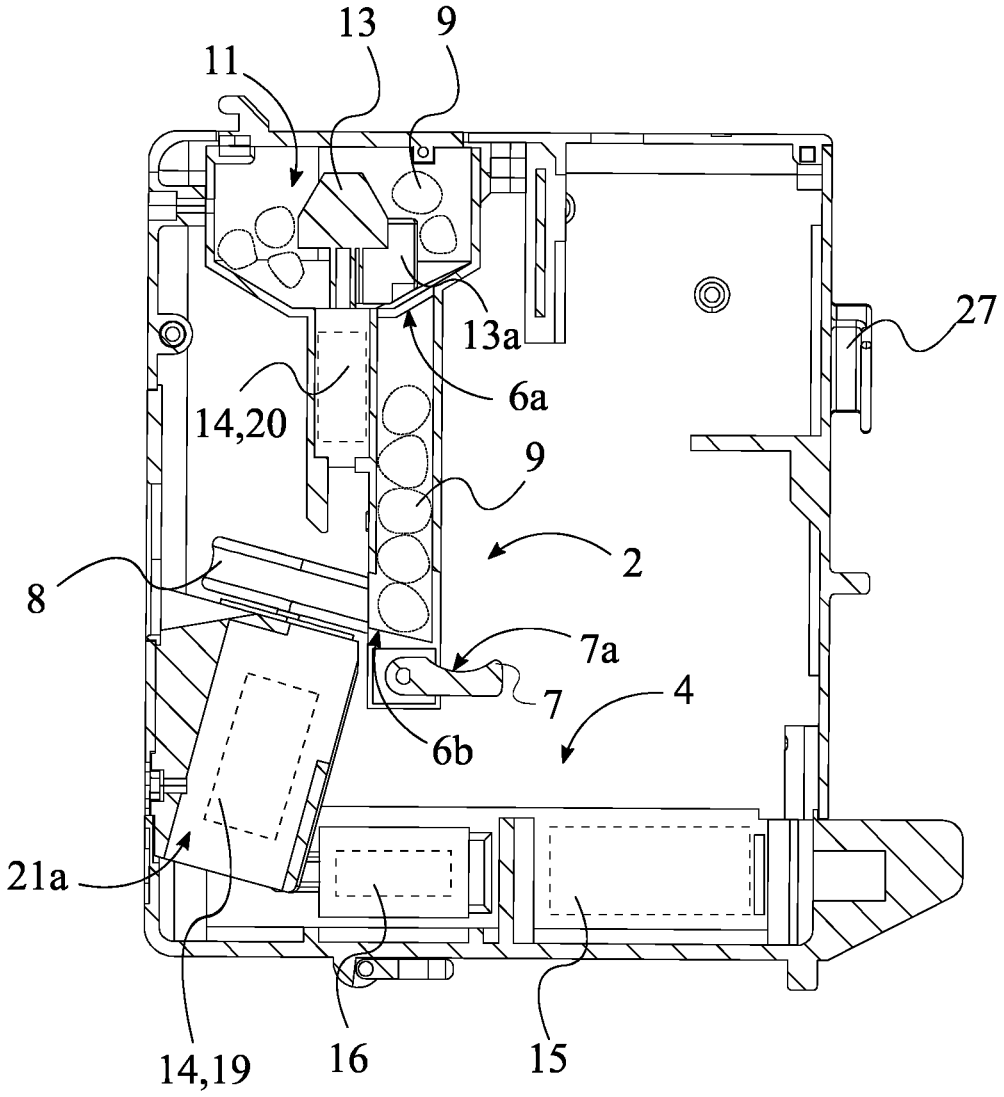
FIG. 8 is a sectional view of the present invention, taken along B-B' of FIG. 7, wherein a plurality of bio-degradable projectiles and a plurality of motors are shown.
Figure 12:
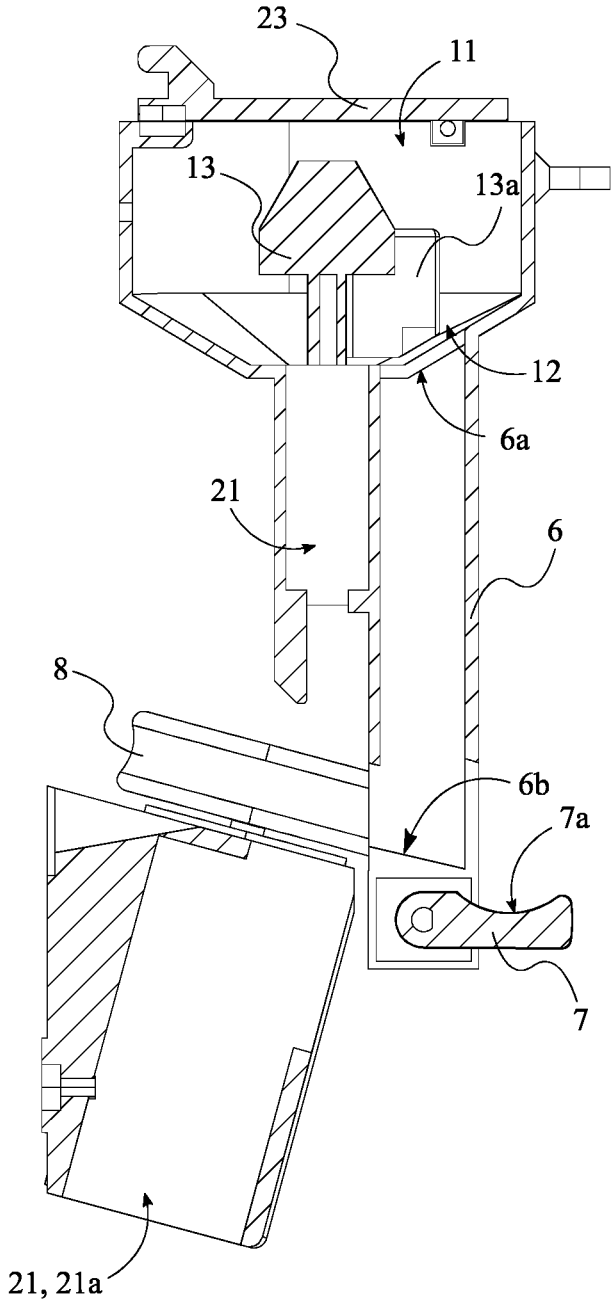
FIG. 12 is a sectional view taken along C-C' of FIG. 11.

According to the preferred embodiment, the launcher 3 comprises a launching tube 6, a rotating arm 7 and a plurality of wheels 8. Preferably, the launcher 3 is intended to launch biodegradable balls in an automated fashion, and the launching tube 6 is intended to line up the balls ready for launching. To that end, a first end 6*a* of the launching tube 6 is mounted onto the ball carrier 2. This is so that the balls from the ball carrier 2 may traverse to the launching tube 6 through the first end 6*a*. To enable a streamlined and unobstructed flow of balls for launching, the launching tube 6 comprises a long square pipe. Further, the rotating arm 7 is mounted adjacent a second end 6*b* of the launching tube 6, wherein the first end 6*a* is positioned opposite to the second end 6*b* across the launching tube 6. As seen in FIG. 8 and FIG. 12, the first end 6*a* and the second end 6*b* of the launching tube 6 comprises oblique surfaces. This is so that the slope or the oblique ends causes a plurality of balls 9 to remain in the launching tube 6 until the rotating arm 7 comes around and pushes them out to be launched by the plurality of wheels 8. Further, the oblique second end 6*b* prevent the balls to fall forward due to gravity, thereby preventing launching of two balls at a time. The rotating arm 7 is used to push the balls out of the launching tube 6 and towards the rotating plurality of wheels 8 that will launch them outwards. The design of the rotating arm 7 is such that, it has a curved front surface 7*a* where it makes contact with the ball and a straight back. This arrangement is so that, the rotating arm 7 may push the ball at the second end 6*b* of the launching tube 6, towards the launching wheels or the plurality of wheels 8. Accordingly, the plurality of wheels 8 is mounted adjacent the second end 6*b*. As seen in FIG. 6, FIG. 8 and FIG. 12, the plurality of wheels 8, the rotating arm 7 and the launching tube 6 are positioned in such a way that, the plurality of balls 9 falling from the ball carrier 2 towards the second end 6*b* of the launching tube 6, wait for the rotating arm 7 to come around and push them forward to the launching wheels or plurality of wheels 8. In other words, the rotating arm 7 is rotatably coupled between the plurality of wheels 8 and the second end 6*b* of the launching tube 6.

Figure 3:
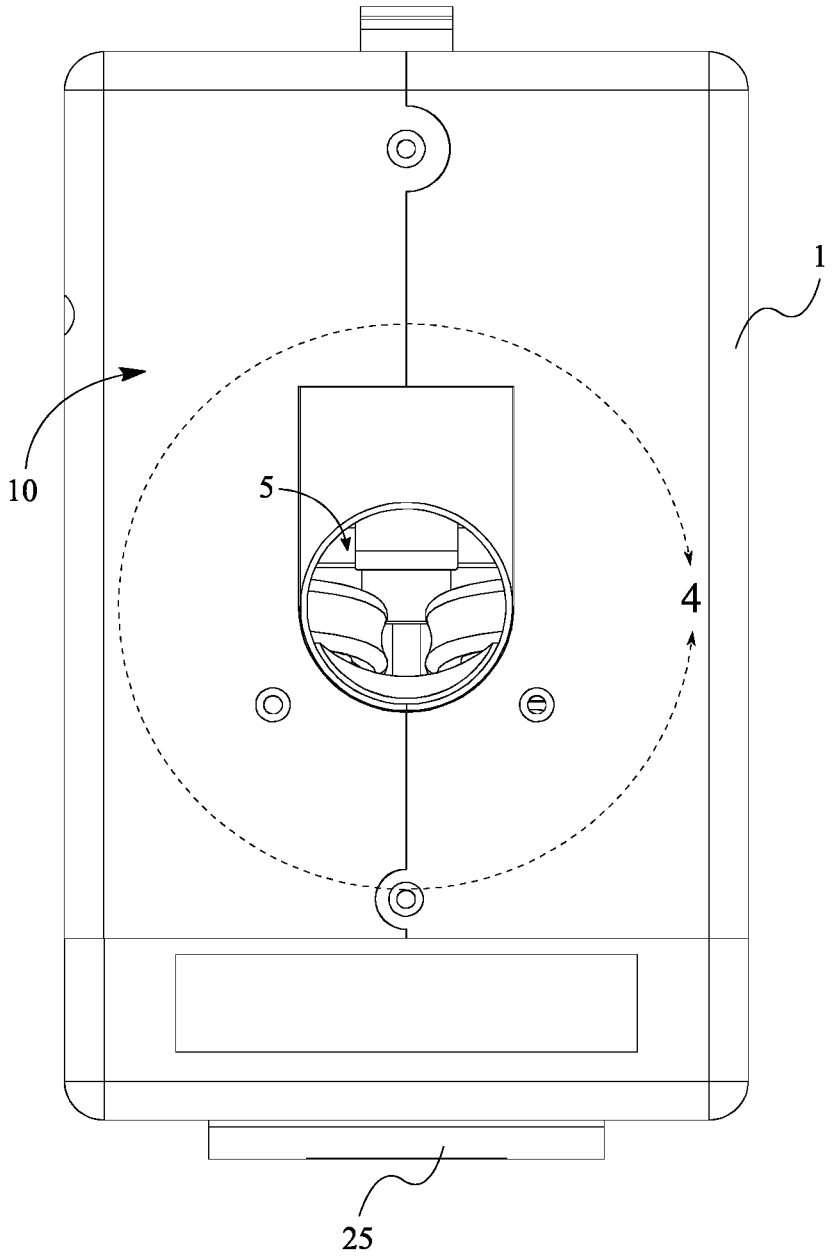
FIG. 3 is a front elevational view of the present invention.
Figure 4:
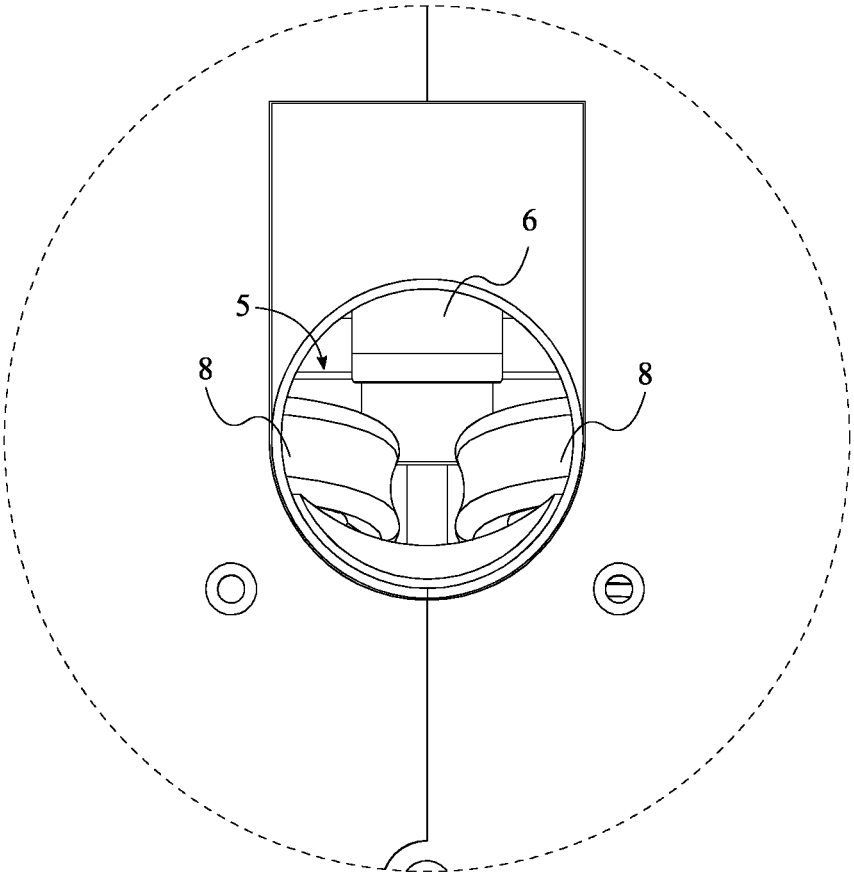
FIG. 4 is a detailed view of section 4 of FIG. 3.

To enable mechanical motion or rotation of the rotating arm 7, as well as spinning of the plurality of wheels 8 and thus automated launching of the plurality of balls 9 in the launching tube 6, the rotating arm 7 and the plurality of wheels 8 are electronically coupled to the powering unit 4. The intention of the present invention is that the plurality of balls 9 that have been pushed towards the spinning plurality of wheels 8 will be launched in a projectile motion through the launching port 5. To that end, the launching port 5 traverses through a first surface 10 of the main housing 1 as seen in FIG. 3 and FIG. 4. Thus, the launcher 2 is operably oriented towards the launching port 5, such that a ball pushed towards the plurality of wheels 8 by the rotating arm 7 is launched out through the launching port 5. Preferably, the launching port 5 is circular. However, the launching tube 6, the rotating arm 7, and the launching port 5 may comprise any other size, shape, components, and arrangement of components that are known to one of ordinary skill in the art, as long as the intents of the present invention are fulfilled.

Figure 9:
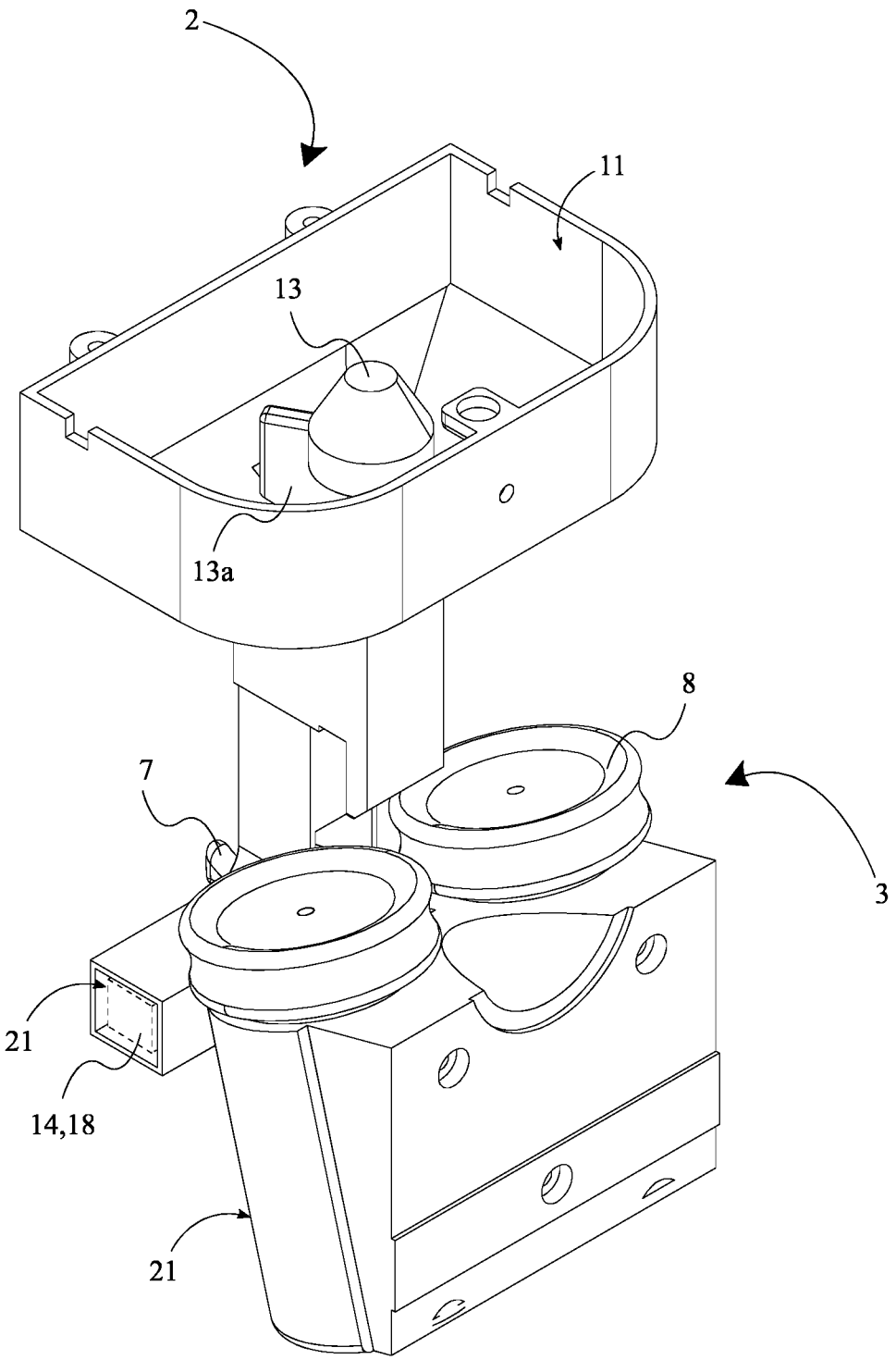
FIG. 9 is a top-front-right perspective view of the present invention without the main housing.
Figure 10:
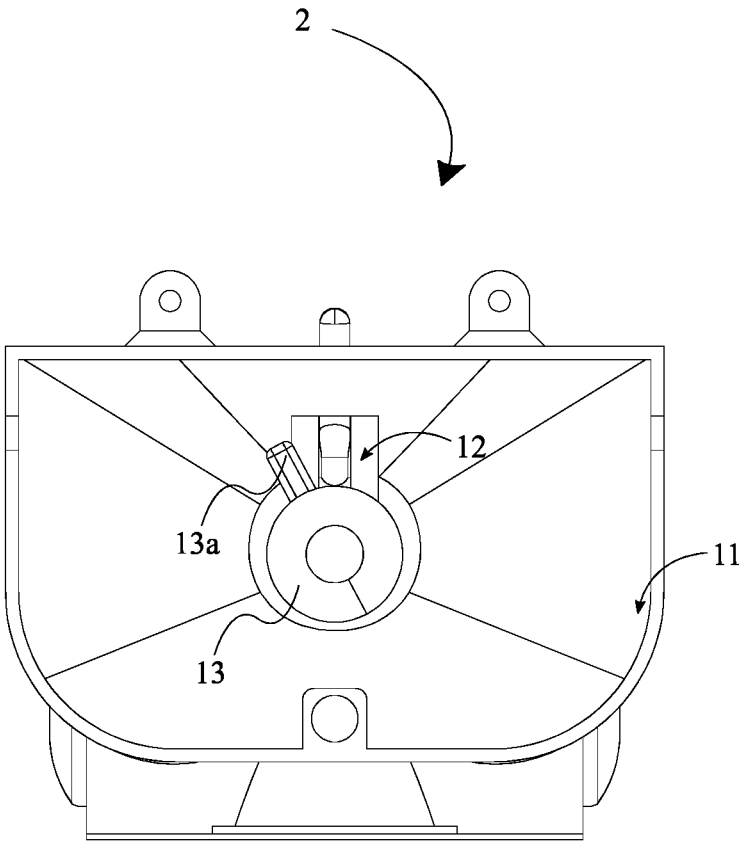
FIG. 10 is a top plan view of the present invention without the main housing.

In the preferred embodiment, the ball carrier 2 will house biodegradable balls and feeds balls to the launcher 2 through the launching tube 6. To accomplish this, the ball carrier 2 comprises a storage cavity 11, a ball-drop aperture 12, and a ball shaker 13. Preferably, the storage cavity 11 houses the projectiles and the ball-drop aperture 12 traverses into the storage cavity 11. This arrangement is so that, the plurality of balls 9/projectiles stored within the storage cavity 11 may fall into the launching tube 6 through the ball-drop aperture 12. To enable this, the first end 6*a* of the launching tube 6 is oriented towards the ball-drop aperture 12. In order to continuously direct the plurality balls 9 to the launching tube 6 and shake up the plurality of balls 9 so that the plurality of balls 9 balls don't get stuck, the ball shaker 13 is mounted within the storage cavity 11 adjacent the ball-drop aperture 12. In other words, the ball shaker 13 is rotatably coupled within the storage cavity 11, such that rotation of a flexible arm 13*a* of the ball shaker 13 directs each ball from a plurality of balls 9 within the storage cavity 11 into the ball-drop aperture 12. This flexibility of the flexible arm 13*a* would allow the ball shaker 13 to continue its circular motion and help prevent any future stalls. For example, in the event that the plurality of balls 9 is in a peculiar position that wouldn't allow any more movement of the plurality of balls 9 to the launching tube 6, the flexible arm 13*a* of the ball shaker 13 would move over and flex to a point where it can continue its circular motion and shake up the remainder of the plurality of balls 9 while the obstruction is being moved by gravity in the launching tube 6. Further, the ball shaker 13 and the movement of the plurality of balls 9 avoids any delays at point of launch. This is advantageous because, considering the time needed by user to be able to time a good and consistent approach for better effectiveness, it is important that the ball shaker 13 is present to continually move the plurality of balls 9 around that way where they will fall into the launching tube 6 and have them be ready for launch at the timed intervals set by the user. As seen in FIG. 9 and FIG. 12, the storage cavity 11 comprises tapering walls, so that gravity works in favor of the plurality of balls 9 falling into the launching tube 6. In other words, the ball carrier 2 has a slope towards the center of its design where the ball shaker 13 is located and the launching tube 6 is connected. Thus, using gravity, the plurality of balls 9 within the storage cavity 11 will fall towards the middle, and the ball shaker 13 will further move the plurality of balls 9 to the launching tube 6 through the ball drop aperture 12, in order to set them up for launch. Further, some balls from the plurality of balls 9 will naturally fall into the launching tube 6 because of their close proximity to the center of the slope.

It is proposed that this launching mechanism will permit the use of biodegradable projectiles that may otherwise be deformed or damaged by conventional spring-loaded magazines or other compression-based mechanisms. Preference is given to the use of biodegradable materials to avoid littering an outdoor practice area with loose or lost projectiles, minimizing any negative environmental impact. Accordingly, in the preferred embodiment, the plurality of balls 9 is biodegradable, and comprises varying dimensions. Preferably, the plurality of balls 9 is spherical and vary in size anywhere from 5 mm to 20 mm (9.3 mm to 9.6 mm). Further, the idea of using a really small biodegradable ball as a target will improve hand eye coordination, reflexes, timing, awareness, pitch recognition, power and contact, thereby giving the user an ultimate gaming experience. Additionally, by using small brown biodegradable balls for practice, the change in color will improve or enhance the user's field of perception compared to a baseball or softball. (making the baseball or softball appear larger). However, the plurality of balls 9 may comprise any other dimension and shape, as long as the intents of the present invention are not hindered. Further, the plurality of balls 9 may be made of any material that dissolves when wet. Preferably, the plurality of balls 9 are made of a dirt, mud/clay like material that resembles the same material on dirt fields, and they break on forced contact into smaller pieces. The variation of the size of the biodegradable balls and the speed and distance of the plurality of wheels 8 helps users get different speed and angle of trajectory for each biodegradable ball launched, making the present invention a unique training aid for all hitters. In other words, the present invention enables various pitch location technology. Furthermore, this sort of training aid would allow the user to focus on improving their hitting mechanism and their approach without needed the time to go and pick up the biodegradable balls resting assured that the balls would dissolve with water into the earth and not cause any environment harm.

It is an aim of the present invention to provide an automated projectile launching system. To accomplish this, the powering unit 4 comprises a plurality of motors 14, a power source 15, a microcontroller 16, and a human interface device (HID) 17. Preferably, the plurality of motors 14 comprises small dc motors that can convert electrical energy into mechanical energy, and the power source 15 is a rechargeable battery, that is used to deliver electrical power to the other components of the powering unit 4. However, any other source of power, or a combination of the following sources may be employed for the smooth functioning of the present invention. Examples of such power sources include, but are not limited to, Li ion batteries, magnetic power converters, solar power converters, etc. Preferably, the powering unit 4 is mounted within the main housing 1, and the main housing 1 may comprise additional ports, vents etc. that may provide accessibility to the components of the powering unit, such as a charging cable, USB port etc. Additionally, the powering unit 4 may comprise an electrical terminal that allows the present invention to receive electrical power from an external power supply, and/or an electrical terminal that allows the present invention to send electrical power to an external electrical load. To accomplish the smooth operation of the various components connected, the plurality of motors 14 is electrically coupled to the power source 15. Furthermore, the plurality of motors 14 and the HID 17 are electronically coupled to the microcontroller 16. Preferably, the microcontroller 16 is a processing device that interprets commands received from the HID 17 and uses these commands to manage the operation of the electrical components within the present invention. Further, the microcontroller 16 may comprise a wireless communication module, that connects and communicates with external devices via wireless data transmission protocols. Example standards of what the wireless communication module is capable of using includes, but are not limited to, Bluetooth, WI-FI, GSM, CDMA, ZigBee, etc.

Continuing with the preferred embodiment, the HID 17 may comprise at least one push button or rotatable knob, that is integrated into main housing 1, such that, a user may easily access the HID 17 for performing the various operations associated with the HID 17. Example operations include, but are not limited to, turning on a lighting device, changing the power of the power source, etc. For example, the user may start the device on a low voltage, which corresponds to a low rpm (rotations per minute) for the plurality of wheels 8, and gradually increase the voltage, the spinning speed of the plurality of wheels 8, and thus launching speed, with the help of the HID 17. Further, the HID 17 may be connected to the lighting device, which may be positioned in front of the launching mechanism in order to provide illumination for better visibility of the biodegradable balls through the launching port 5.

In order to accomplish the smooth operation of the pitching device, the plurality of motors 14 is connected to various mechanical components. Accordingly, a first motor 18 from the plurality of motors 14 is operably coupled to the rotating arm 7, such that activating the first motor 18 governs rotation of the rotating arm 7. This is so because, the variation in size and weight of each biodegradable ball requires the need to push each ball forward, to make contact with the plurality of spinning wheels 8. In other words, a force is needed to be applied to each ball (from the plurality of balls 9) from behind in order for them to make contact with the spinning plurality of wheels 8. Thus, the first motor 18 powers the rotating arm 7 and pushes each ball from the plurality of balls 9 through the spinning plurality of wheels 8, until the ball make contact and is launched by the rotation and momentum of the plurality of wheels 8. To that end, at least one second motor 19 from the plurality of motors 14 is operably coupled to the plurality of wheels 8, such that activating the second motor 19 governs spinning of the plurality of wheels 8. Further, a third motor 20 from the plurality of motors 14 is operably coupled to the ball shaker 13, such that activating the third motor 20 governs rotation of the ball shaker 13. Preferably, the third motor 20 is a small stepper, servo or micro dc motor, that is connected to the ball shaker, so as to continuously move the plurality of balls 9 to the launching tube 6 or shake up the plurality of balls 9 so that the biodegradable plurality of balls 9 don't get stuck. However, it should be noted that, the first motor 18, the at least one second motor 19, and the third motor 20 may comprise any other size, brand, and technology, as long as the intents of the present invention are not altered.

Figure 11:
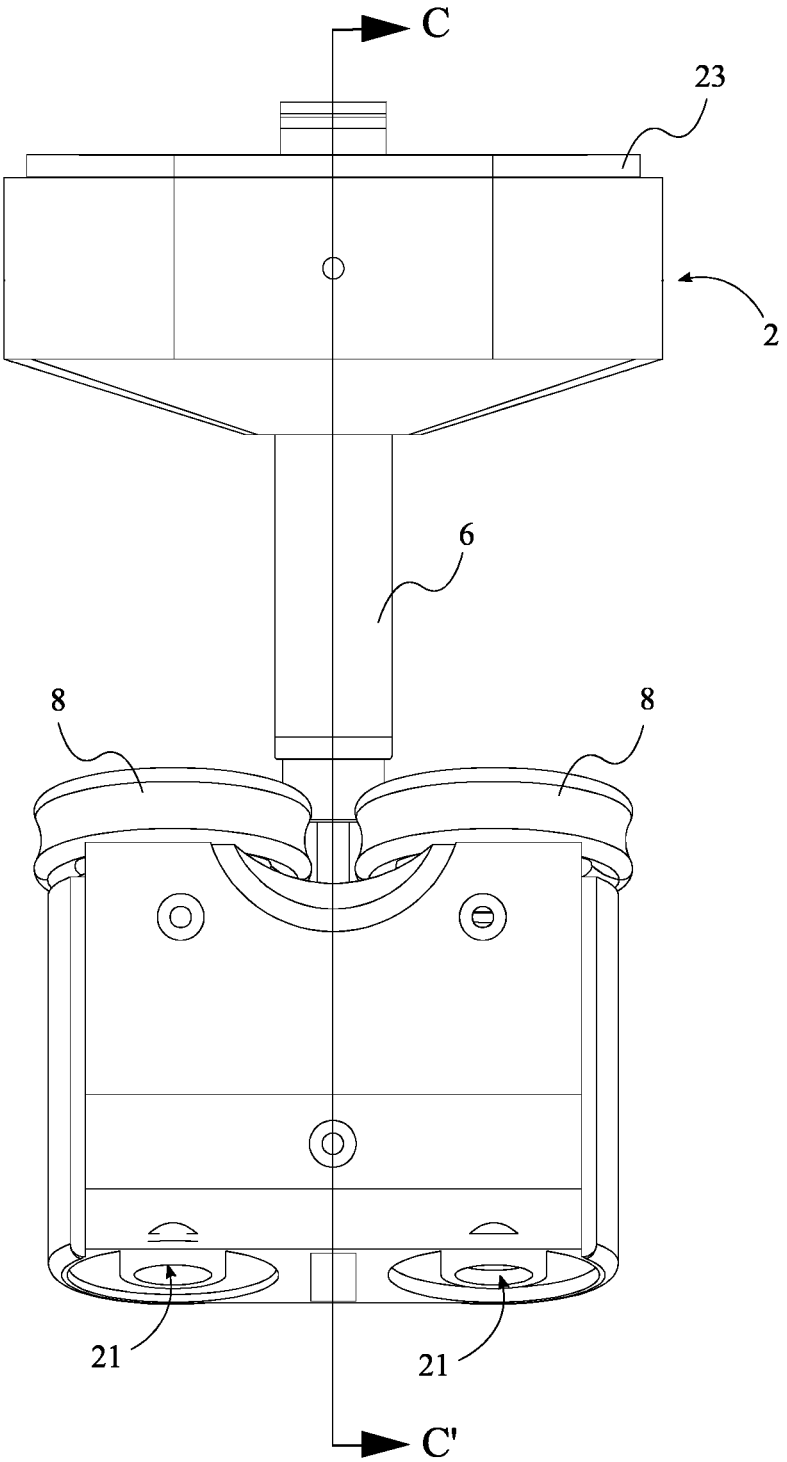
FIG. 11 is a front elevational view of the present invention without the main housing.

In the preferred embodiment, the present invention comprises a plurality of motor holding cavities 21. Preferably, the plurality of motor holding cavities 21 is mounted within the main housing 1, and each of the plurality of motors 14 is mounted within a corresponding motor holding cavity 21*a*, wherein the corresponding motor holding cavity 21*a* is from the plurality of motor holding cavities 21. As seen in FIG. 11, two motor holders from the plurality of motor holding cavities 21 consists of two slots for the at least one second motor 19. The two motor holders are also positioned angularly offset from the launching tube 6. This is so that the biodegradable balls may be propelled towards the user at a reasonable height, such that the user would be able to interact with the product successfully from a flat plain. The plurality of motor holding cavities 21 further comprises enclosed cavities for the third motor 20 and the first motor 18, as seen in FIG. 8 and FIG. 9.

In reference to FIG. 6, the present invention has a cut out 22 for the rotating arm 7 to pass through. The cut out 22 is meant for the rotating arm 7 motion to be able to push the biodegradable balls to make contact with the plurality of spinning wheels 8 in order for the plurality of balls 9 to be launched through the launching port 5.

As seen in FIG. 8 and FIG. 12, the plurality of wheels 8 is angularly offset from the launching tube 6. Preferably, the plurality of wheels 8 is set at an angle of 15 degrees approximately, to achieve the projectile motion while launching the plurality of balls 9 through the launching port 5. In other words, if the plurality of wheels 8 is oriented straight or parallel to the ground, the balls will be shot straight. Further, it is preferred that the plurality of wheels 8 is flexible. This is so that, a flexible material such as rubber or a similar material would give the wheels 8 a light but allowable gripping potential. Preferably, the design of the plurality of wheels 8 is made in a way that the plurality of wheels 8 is able to grip the plurality of bio-degradable balls of varying dimensions on either side. Thus, the separation of the plurality of motors 14 and the plurality of wheels 8 allows the rotating arm 7 to push or force the biodegradable ball, to make contact with the plurality of wheels 8 rotating at a preset speed, causing the plurality of balls 9 to be launched.

As seen in FIG. 1, FIG. 8, FIG. 11 and FIG. 12, the present invention comprises a door 23, wherein the door 23 is hingedly mounted onto a second surface 24 of the main housing 1 adjacent the ball carrier 2. Preferably, the door 23 covers the storage cavity 11 and acts as the access way for putting the plurality of balls 9 into the ball carrier 2. The door 23 may be fastened by any fastening mechanisms, such as magnetic fasteners, snap-on fasteners, bolted fasteners etc., as long as the objectives of the present invention are not altered.

Figure 2:
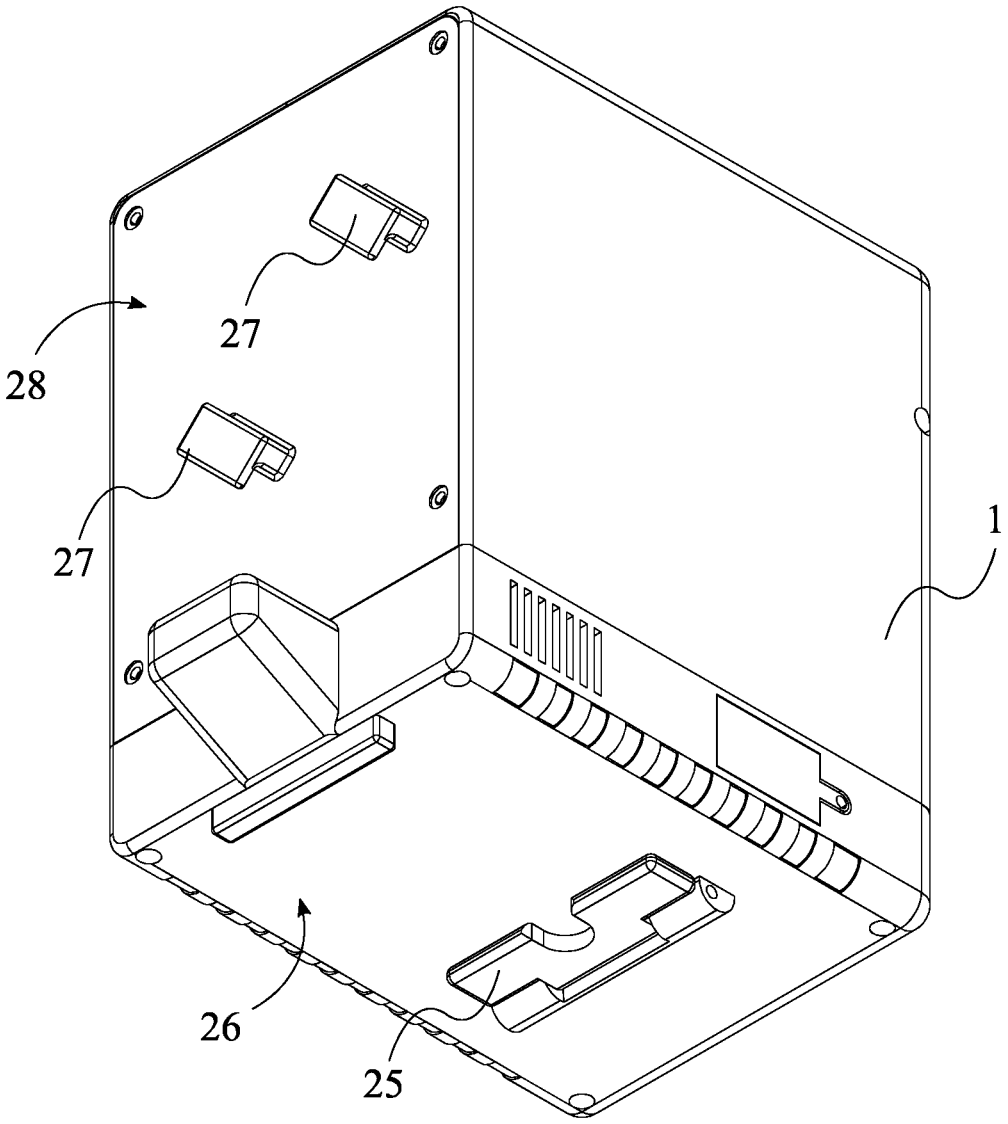
FIG. 2 is a bottom-rear-right perspective view of the present invention.

As seen in FIG. 2, the present invention comprises a foldable leg 25, and the foldable leg 25 is mounted onto a third surface 26 of the main housing 1, opposite to the second surface 24. Preferably, the foldable leg 25 may be unfolded to increase the angle of the trajectory of the launched ball. In other words, the foldable leg 25 may be unfolded to launch the ball at a higher angle to simulate the different positions of the strike zone. Thus, using the present invention, the user or hitter will see different variations in pitches that would train their brain to simulate real game play.

Figure 5:
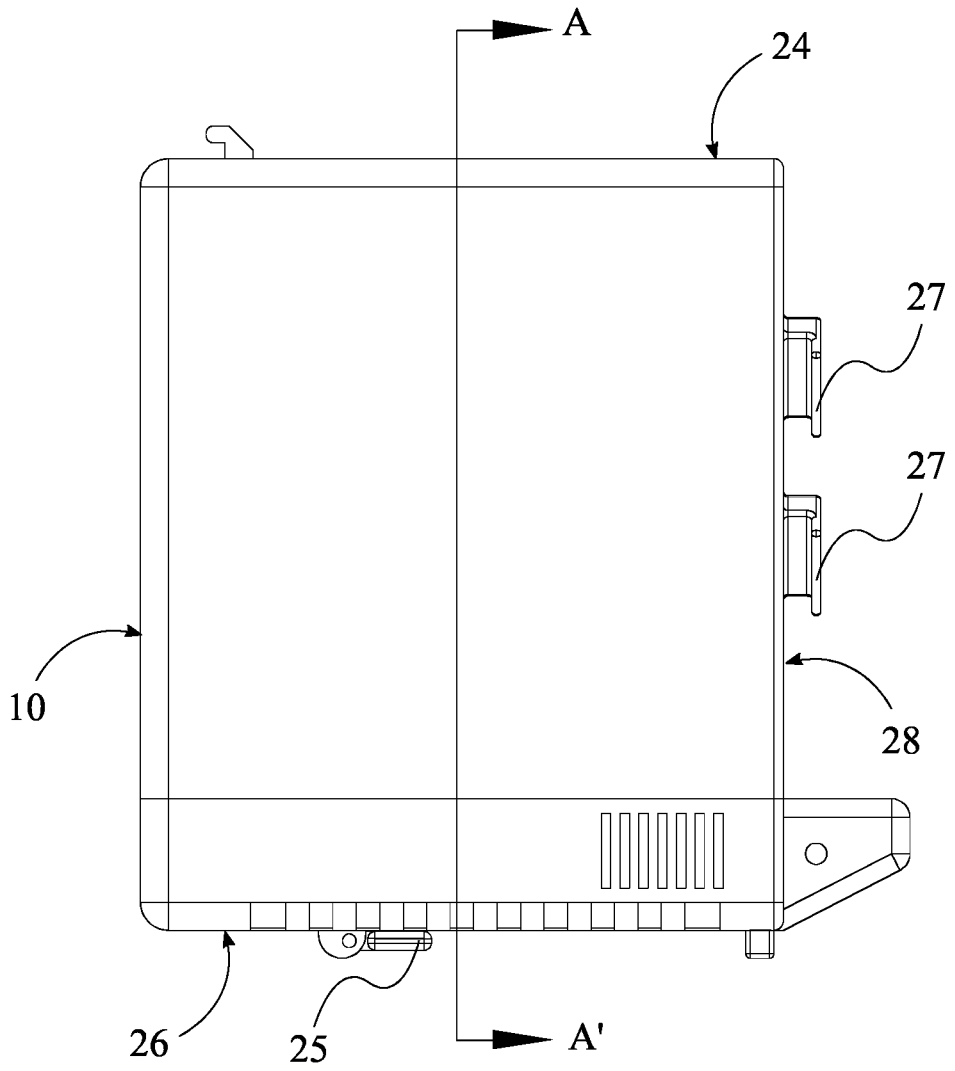
FIG. 5 is a left side elevational view of the present invention.

In reference to FIG. 2 and FIG. 5, the present invention comprises at least one hanger 27, wherein the at least one hanger is mounted onto a fourth surface 28 of the main housing 1, opposite to the first surface 10. This is so that the present invention may be hung off a fence with the help of the at least one hanger 27, giving the user flexibility in positioning of the automated launcher. Thus, instead of only being able to use on the ground level, the user would be able to hang and use the present invention at different heights based on user preference.

In an alternate embodiment, the launching port 5 may comprise a deeper recess extending from the first surface 10 towards the fourth surface 28 of the main housing, and thereby partially exposing the ball carrier 2 and the launching tube 6. This arrangement is so that the user may have better visibility of the balls that are getting ready for launching, and thus better perception.

Although the invention has been explained in relation to its preferred embodiment, it is to be understood that many other possible modifications and variations can be made without departing from the spirit and scope of the invention as hereinafter claimed.

What is claimed is:

1. An automated projectile launcher device comprising:
- a main housing;
- a ball carrier;
- a launcher; and
- a powering unit;
- a launching port;
- at least one hanger;
- the launcher comprising a launching tube, a rotating arm, and a plurality of wheels;
- the ball carrier, the launcher, and the powering unit being mounted within the main housing;
- a first end of the launching tube being mounted onto the ball carrier;
- the rotating arm being mounted adjacent a second end of the launching tube, wherein the first end is positioned opposite to the second end across the launching tube;
- the plurality of wheels being mounted adjacent the second end;
- the rotating arm and the plurality of wheels being electronically coupled to the powering unit;
- the rotating arm being rotatably coupled between the plurality of wheels and the second end of the launching tube;
- the launching port traversing through a first surface of the main housing;
- the launcher being operably oriented towards the launching port, such that a ball positioned within the launching tube is pushed towards the plurality of wheels by the rotating arm and is launched out through the launching port; and
- the at least one hanger being mounted onto a fourth surface of the main housing, opposite to the first surface.

2. The automated projectile launcher of claim 1, the ball carrier comprising:
- a storage cavity;
- a ball-drop aperture; and
- a ball shaker;
- the ball-drop aperture traversing into the storage cavity;
- the ball shaker being mounted within the storage cavity adjacent the ball-drop aperture;
- the ball shaker being rotatably coupled within the storage cavity, such that rotation of a flexible arm of the ball shaker directs each ball from a plurality of balls within the storage cavity into the ball-drop aperture; and
- the first end of the launching tube being oriented towards the ball-drop aperture.

3. The automated projectile launcher of claim 2, comprising:
- the plurality of balls being biodegradable; and
- the plurality of balls comprising varying dimensions.

4. The automated projectile launcher of claim 2, wherein the storage cavity comprising tapering walls.

5. The automated projectile launcher of claim 1, the powering unit comprising:
- a plurality of motors;
- a power source;
- a microcontroller; and
- a human interface device (HID);
- the powering unit being mounted within the main housing;
- the plurality of motors being electrically coupled to the power source; and
- the plurality of motors and the HID being electronically coupled to the microcontroller.

6. The automated projectile launcher of claim 5, comprising:
- a first motor from the plurality of motors being operably coupled to the rotating arm, such that activating the first motor governs rotation of the rotating arm;
- at least one second motor from the plurality of motors being operably coupled to the plurality of wheels, such that activating the second motor governs spinning of the plurality of wheels; and
- a third motor from the plurality of motors being operably coupled to the ball shaker, such that activating the third motor governs rotation of the ball shaker.

7. The automated projectile launcher of claim 5, comprising:
- a plurality of motor holding cavities;
- the plurality of motor holding cavities being mounted within the main housing; and each of the plurality of motors being mounted within a corresponding motor holding cavity, wherein the corresponding motor holding cavity is from the plurality of motor holding cavities.

8. The automated projectile launcher of claim 1, wherein the plurality of wheels being angularly offset from the launching tube.

9. The automated projectile launcher of claim 1, wherein the plurality of wheels being flexible.

10. The automated projectile launcher of claim 1, the main housing comprising:

a door; and the door being hingedly mounted onto a second surface of the main housing adjacent the ball carrier.

11. The automated projectile launcher of claim 10, comprising:

a foldable leg; and the foldable leg being mounted onto a third surface of the main housing, opposite to the second surface.

12. The automated projectile launcher of claim 1, wherein the first end and the second end of the launching tube comprising oblique walls.

* * * * *